US009151024B2

(12) United States Patent
Dutheil

(10) Patent No.: US 9,151,024 B2
(45) Date of Patent: Oct. 6, 2015

(54) SHOWER COLUMNS OR PANELS

(75) Inventor: Daniel Dutheil, Meshers (FR)

(73) Assignee: Les Robinets Presto, Montrouge (FR)

( * ) Notice: Subject to any disclaimer, the term of this patent is extended or adjusted under 35 U.S.C. 154(b) by 463 days.

(21) Appl. No.: 13/643,798

(22) PCT Filed: Mar. 31, 2011

(86) PCT No.: PCT/FR2011/000193

§ 371 (c)(1),
(2), (4) Date: Jan. 11, 2013

(87) PCT Pub. No.: WO2011/135197

PCT Pub. Date: Nov. 3, 2011

(65) Prior Publication Data

US 2013/0104308 A1 May 2, 2013

(30) Foreign Application Priority Data

Apr. 27, 2010 (FR) ..... 10 01787

(51) Int. Cl.
*E03C 1/04* (2006.01)
*E03D 3/00* (2006.01)

(52) U.S. Cl.
CPC ..... *E03C 1/04* (2013.01); *E03C 1/0408* (2013.01); *E03D 3/00* (2013.01)

(58) Field of Classification Search
CPC ..... F16K 21/04; F16K 21/06; F16K 21/08; F16K 21/10; F16K 31/563
USPC ..... 4/612–614, 677; 137/359, 360; 251/15–23
See application file for complete search history.

(56) References Cited

U.S. PATENT DOCUMENTS

| | | | | |
|---|---|---|---|---|
| 3,146,916 | A * | 9/1964 | Kronheim | 222/182 |
| 2009/0007319 | A1 | 1/2009 | Funari et al. | |
| 2011/0005608 | A1 | 1/2011 | Miyagi et al. | |

FOREIGN PATENT DOCUMENTS

| | | | |
|---|---|---|---|
| EP | 1548344 | A1 | 6/2005 |
| EP | 1 589 154 | A2 | 10/2005 |
| FR | 2 492 942 | | 4/1982 |
| JP | 2002071050 | A | 3/2002 |
| JP | 2009191520 | A * | 8/2009 |

* cited by examiner

*Primary Examiner* — Janie Christiansen
(74) *Attorney, Agent, or Firm* — Renner, Kenner, Greive, Bobak, Taylor & Weber

(57) ABSTRACT

Improvements to shower panels and, more particularly to the lower part of such a panel, connected to the upper one by a metallic protective sleeve (3), characterized in that said lower part comprises a casing in two parts, one of which forming a base (6) and comprising means to allow it being fixated against the usual membrane and to maintain a priming valve (1), while the other (11), which totally covers the first part, and the lower part of the sleeve forms a metallic protecting shell and comprises means for operating the usual pusher (2) of said priming valve and to evacuate the water resulting of the discharging of said priming valve and of the main valve disposed at the upper part of the panel.

8 Claims, 5 Drawing Sheets

SHOWER COLUMNS OR PANELS

The present invention relates to improvements to shower columns or panels.

A shower panel is generally made of three parts:

An upper part comprising the shower sprinkler head, the controlling device for controlling the flowing of water, such as a delayed closing valve, and the arrival of water, a lower part comprising the operating unit and a post mechanically connecting these two parts and protecting the ducting which makes the connection between them.

Such a device is disclosed, very notably in French patent 2,492,942.

The above mentioned operating unit is made of a delayed closing valve, called a discharge valve, the water entrance thereof being connected to the discharging opening of the main valve disposed in the upper part.

A discharge valve comprises a pusher which, when pressed, controls the opening of the main valve.

A prolonged action on the above mentioned pusher should not allow the disfunctioning of the delaying and successive improvements have come to the making of a discharge valve such as the one disclosed in the French patent application filed by the assignee of the present application on Mar. 26, 2010 under the number 1001205.

Due to its conception, this valve can be wholly moulded in plastic material and the assembling of its constitutive parts is particularly easy.

One goal of the present invention is to provide an assembly of means allowing in particular the efficient use of such a discharge valve.

As per the present invention, the lower part of the mounting comprises a casing in two parts, one of which forming a base and comprising means for the fixation thereof against the usual wall and for maintaining the discharge valve, while the other, which totally covers the first one, forms a metallic protecting shell and comprises means for operating the controlling pusher of said valve and for evacuating the water resulting of the discharging of the discharge valve and of the main valve.

Further features will become more apparent from the following description made in reference with the appended drawings, only on an indicative basis, in which FIG. 1 is a front view of the lower part of a shower panel, part to which the invention relates;

Figure 1:
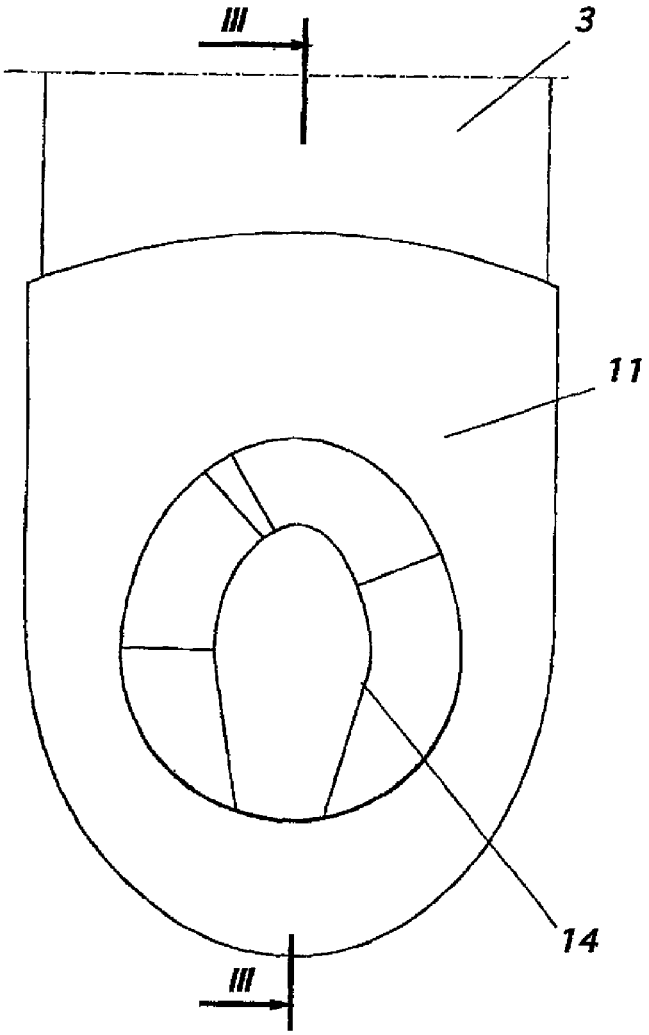

In reference to the drawings, it can be seen that the problem mainly resides in protecting a discharge valve 1, of a known type, the pressing of the pusher 2 thereof allowing the controlling of the opening of a delayed valve disposed in the upper part of the sheath 3.

Of known manner, the valve 1 comprises an entrance opening 4 and an exit opening 5.

The entrance opening 4 is in communication, through a connection piece, not shown, with the discharging opening of the main valve, said connection piece being protected by said sheath 3.

The opening 5 allows discharging of the water contained in the delaying chamber of the main valve.

The valve 1 is maintained by a base 6, preferably moulded in a plastic material, fixated against the supporting wall by means of screws, not shown, passing through openings 7 of said base.

The base 6 comprises means for nesting its upper part 8 in the sheath 3. This base may comprise a tongue 9 enabling, with the aid of a screw whose axis is schematically shown in 9*a*, to fixate said base to the lower part of the sheath. Similar means may be used on the upper part of the panel, ie the part comprising the main valve, to maintain the upper part of the sheath.

The base 6 comprises means for centering and maintaining the valve 1. As per an embodiment, the base 6 comprises arms 10 capable of elastically clamping the body of the valve 1, which is being clipped in the sleeve formed by the arms 10. To this end, it is preferred that at least two arms, diametrally opposed, each comprise a flange oriented toward the inside of the sleeve so as to elastically penetrate in a groove provided on the valve or to bear en against a shoulder (these two alternative means are not shown).

Figure 6:
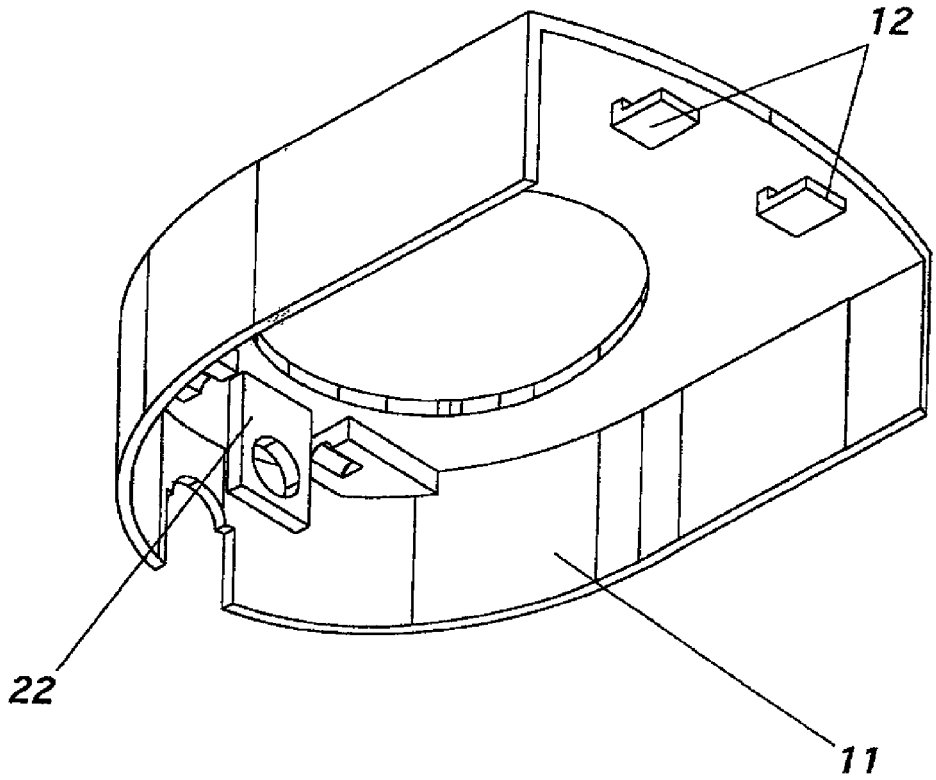
FIG. 6 is a perspective view, from below, of the protective shell.
Figure 7:
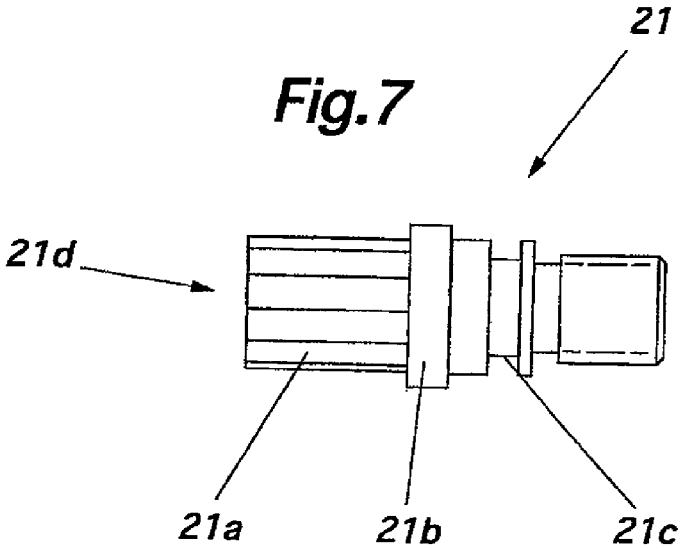
FIG. 7 is a view in perspective of screw 21 shown in FIG. 3.

The base and the valve are covered by a metallic protective shell 11 which partially extends itself on the lower part of the sheath and comprises at least one hook 12 (FIG. 6) extending under the face 3*a* of the sheath.

The base 6 comprises an edge 13 allowing centering of the shell 11, or lid, means being provided for fixating the lid 11 against the base.

The lid 11 comprises an opening 11*a* outside of which extends an articulated metallic paddle 14, comprising a peripheral flange 15 delimitating the extension of said paddle, the internal face of which being in contact with, or extending in the vicinity of, the end of the pusher 2 of the discharge valve. This paddle isolates the valve from the users.

In an embodiment, the paddle 14 comprises two arms 16 each provided with a respective shaft 17. The internal face of the lid comprises two cradles for receiving the above mentioned shafts, which are maintained in the cradles by half bearings 18 fixated by screws the axis thereof being schematically indicated in 19.

By pressing on the paddle, the user presses the pusher 2 and activates the opening process of the main valve.

Figure 2:
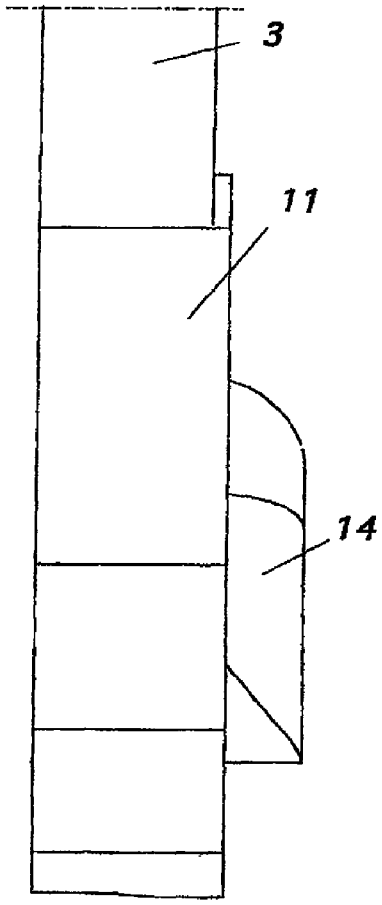
FIG. 2 is a left side view of FIG. 1.
Figure 3:
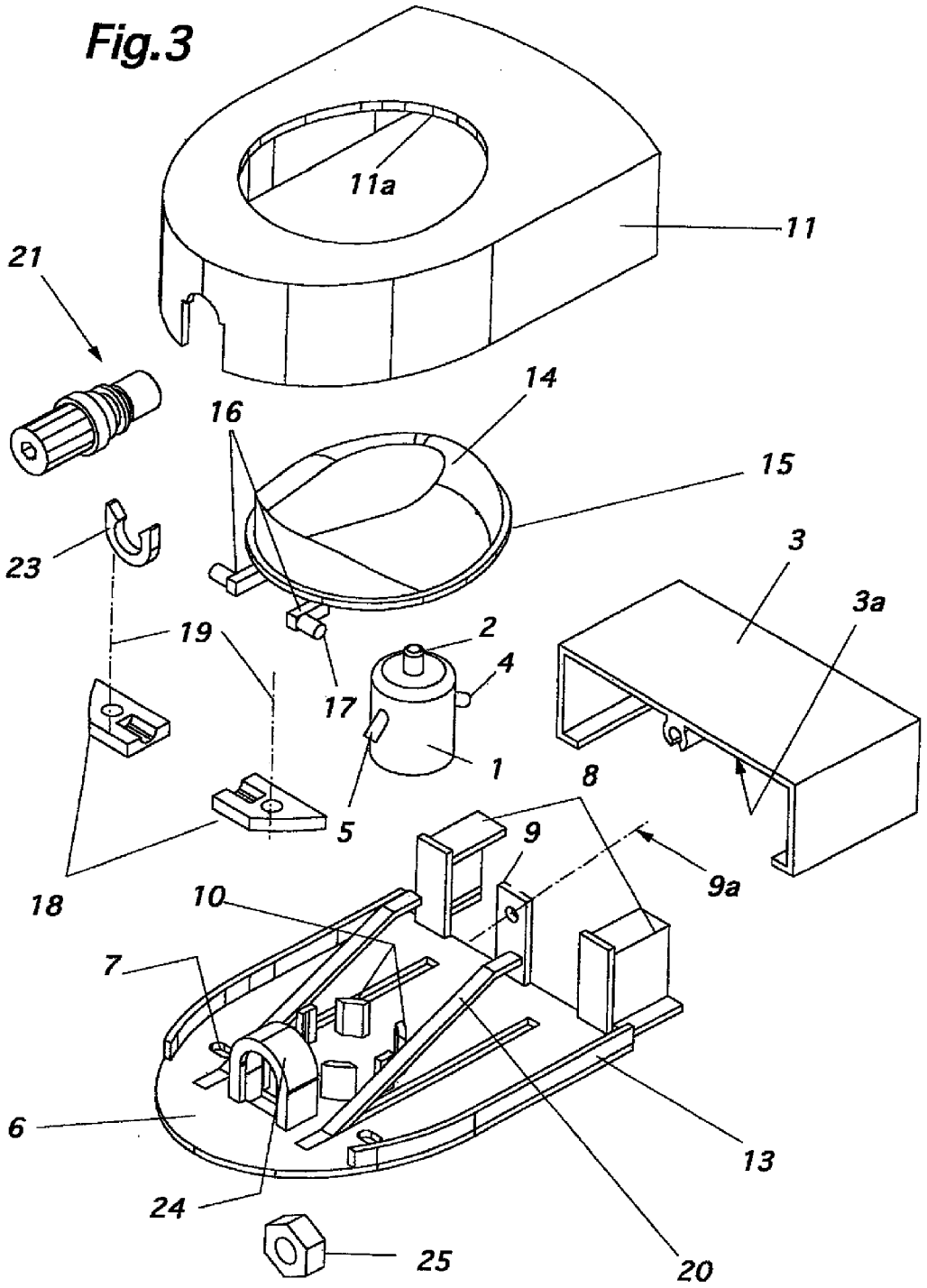
FIG. 3 is an exploded perspective view showing all the components of FIG. 1.

The paddle 14 may be maintained in the position shown in FIG. 2 by the return spring of the pusher 2, but preferably the paddle may be submitted to the action of spring strips 20 the free ends thereof bearing under the flange 15. These strips are made, preferably, during the moulding of the base 6.

The lid 11 comprises a screw 21, the axis thereof being substantially vertical in the use position and extending parallel to the surface on which the base is fixated. This screw is axially immobilized in respect to the lid and the head 21*a* thereof being flush with the lower part of the lid, which advantageously hides said head (see in particular FIG. 4).

The screw 21 comprises a shoulder 21*b* restricting the penetration thereof in a bearing 22 of the lid, the axial immobilization of the screw being obtained by a securing ring or circlip 23 engaged in a groove 21*c*, provided on the side opposite the shoulder relative to said bearing.

The base 6 comprises a threading provided in a cage 24 for receiving the screw 21. In an embodiment, the cage 24 is moulded so as to immobilize, in respect to the base, a nut 25.

Figure 4:
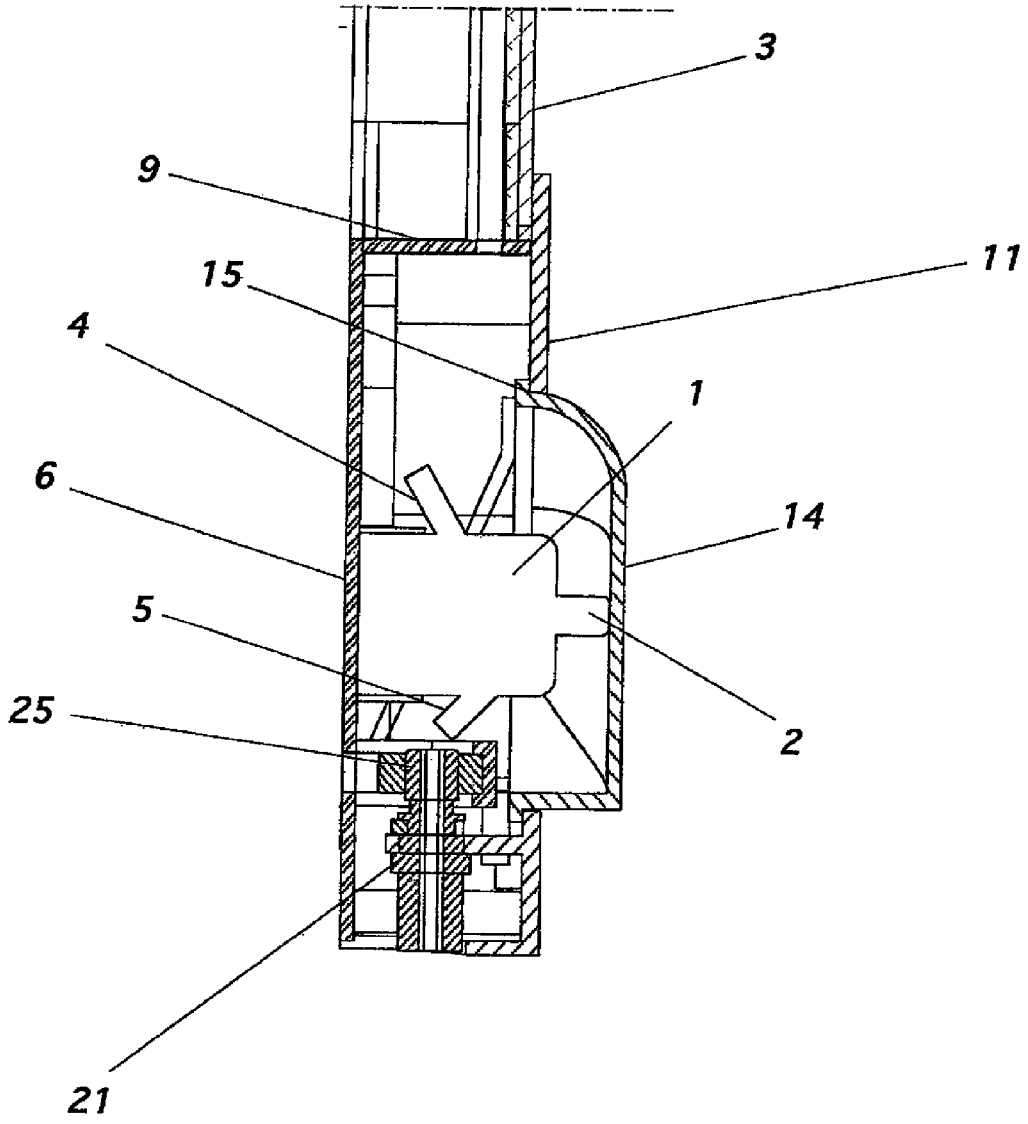
FIG. 4 is a view in cross section along line III-III of FIG. 1.

As shown in FIG. 4, the nut 25 is introduced in the cage 24 through an opening 26 provided in the base 6.

Figure 5:
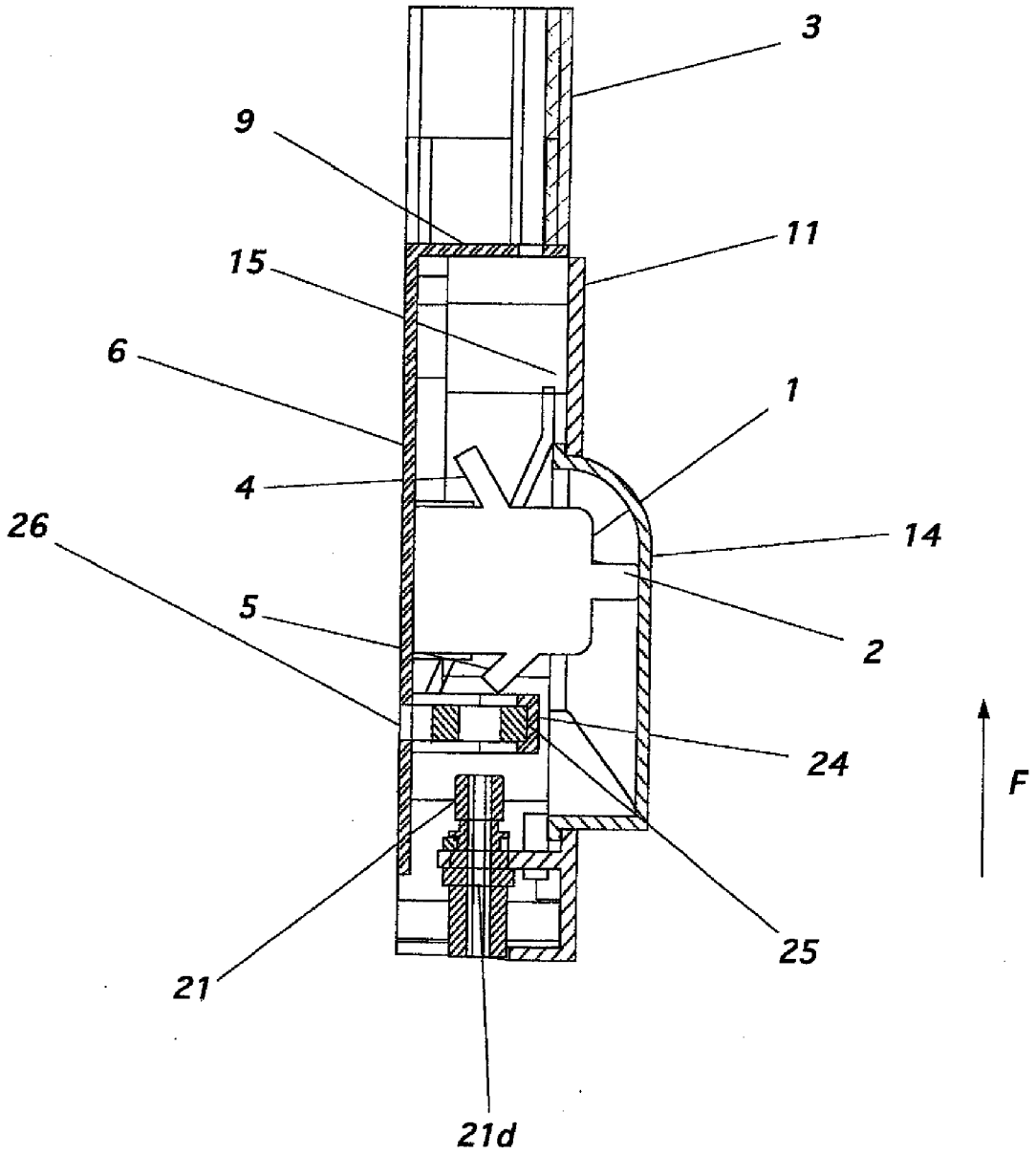
FIG. 5 is a view similar to the view of FIG. 4, showing the placement of the protective shell.

To fixate the lid, it is disposed as shown in FIG. 5 and then is pushed along the direction of arrow F to engage the screw in the nut 25.

The screw 21 is passed through by a canal 21*d* which, in totality or partially, comprises a polygonal shaped section (for example hexagonal) to allow its driving in rotation.

When the lid is fixated on its base, the upper end of the screw 21 emerges just below the exit opening 5 of the valve, as this can clearly be seen on FIG. 4. In this way, the discharged water is directed to the outside by the central hole of the screw 21.

Preferably, the screw 21 is made in a plastic material and fulfills a double function (fixation and evacuation of the water coming form the delaying chambers).

The invention claimed is:

1. A lower part of a shower panel, connected to an upper part by an outer protective sheath, wherein said lower part comprises a casing in two parts, a first part forming a base and comprising means for fixating said base against an outer side of a wall and for maintaining a delayed discharge valve, and a second part totally covering said first part and a lower part of said outer protective sheath, so as to form a protecting shell or lid, and comprising means for operating a pusher of said delayed discharge valve and means for evacuating water resulting from a discharging of delaying chambers of said delayed discharge valve and of a main delayed closing valve disposed at said upper part of said shower panel, the body of the discharge valve being independent of said casing.

2. The lower part of claim 1, wherein the protecting lid comprises a pivoting paddle, the pressing thereof being capable to provocate the pressing of the pusher of the delayed discharge valve.

3. The lower part of claim 2, wherein the pivoting paddle is pushed back by spring strips and a return spring of the pusher.

4. The lower part of claim 1, wherein the base comprises arms, wherein said arms are elastically deformable, forming a sleeve in which the body of the delayed discharge valve is clipped.

5. A lower part of a shower panel connected to an upper part by a protective sheath wherein said lower part comprises a casing in two parts, a first part forming a base and comprising means for fixating said base against an outer side of a wall and for maintaining a delayed discharge valve, and a second part totally covering said first part and a lower part of said protective sheath, so as to form a protecting shell or lid, and comprising means for operating a pusher of said delayed discharge valve and means for evacuating water resulting from a discharging of delaying chambers of said delayed discharge valve and of a main delayed closing valve disposed at said upper part of said shower panel, wherein the fixation of the protecting lid on the base is made by a screw, the screw being carried by the protecting lid and is axially immobilized in respect to the protecting lid, the axis of said screw being vertical and extending parallel to a supporting surface of the base when the panel is in a use position, the screw being able to be screwed in a thread of the base.

6. The lower part of claim 5, wherein said screw is passed through by a channel a upper end of the screw thereof, while in the use position of the panel, emerging just below a exit opening of the delayed discharge valve so as to direct discharge water towards the outside of the valve.

7. The lower part of claim 6, wherein a lower end of the screw is substantially flush with a lower part of the lid.

8. The lower part of claim 5, wherein said thread is a nut immobilized in a cage of said base.

* * * * *